United States Patent [19]

Graushar

[11] Patent Number: 5,025,610

[45] Date of Patent: Jun. 25, 1991

[54] APPARATUS AND METHOD FOR SELECTIVELY PACKAGING MAGAZINES

[75] Inventor: William T. Graushar, Milwaukee, Wis.

[73] Assignee: Quad/Tech, Inc., Pewaukee, Wis.

[21] Appl. No.: 454,041

[22] Filed: Dec. 20, 1989

[51] Int. Cl.[5] ..... B65B 61/26; B65H 39/02

[52] U.S. Cl. ..... 53/411; 53/137; 53/461; 53/493; 53/540

[58] Field of Search ..... 53/168, 202, 52, 55, 53/411, 461, 131, 493, 501, 203

[56] References Cited

U.S. PATENT DOCUMENTS

| | | | |
|---|---|---|---|
| 3,819,173 | 6/1974 | Anderson et al. | 270/54 |
| 4,121,818 | 10/1978 | Riley et al. | 270/54 |
| 4,338,768 | 7/1982 | Ballestrazzi et al. | 53/137 X |
| 4,395,031 | 7/1983 | Gruber et al. | 270/54 |
| 4,484,733 | 11/1984 | Loos et al. | 53/411 X |
| 4,683,708 | 8/1987 | Linder | 53/540 |
| 4,790,119 | 12/1988 | McDaniels et al. | 53/461 X |
| 4,831,809 | 5/1989 | Ballestrazzi et al. | 53/528 X |

*Primary Examiner*—James F. Coan

*Attorney, Agent, or Firm*—Foley & Lardner

[57] ABSTRACT

A system for customizing signatures delivered and processed on a conveyor line according to coded information includes an arrangement for selectively diverting certain signatures on the line to a packaging station at which signatures are individually wrapped, and returning signatures selectively wrapped to the conveyor line in synchronism with other signatures delivered on the conveyor line according to the coded information.

19 Claims, 6 Drawing Sheets

APPARATUS AND METHOD FOR SELECTIVELY PACKAGING MAGAZINES

TECHNICAL FIELD

The present invention relates generally to an apparatus and method for customizing signatures assembled into booklet or magazine form and, more particularly, to an apparatus and method for customized packaging of magazines or like publications for certain subscribers.

BACKGROUND OF THE INVENTION

Collating and binding systems for saddle stitchers are well known in the printing industry for mass producing booklets, magazines, catalogues, advertising brochures and the like. Typically, one or more sharply folded and generally pre-printed blanks or signatures are selectively and sequentially fed by a number of spaced signature feeders. The signatures are delivered such that the folded margins or spines of the signatures come to rest upon a collating conveyor line or chain which travels past the signature feeders. The conveyor gathers the signatures, one on top of the other, and moves them, through one or more on-line printing stations, to a stitching or binding station. The assembled signatures then are usually diverted to a trimming station and further led to a labeling station where mailing labels which are pre-printed or printed on-line are affixed. Thereafter, the assembled and labeled signatures are sorted, bundled and readied for distribution.

Prior art systems of this type contemplate the computer controlled production of various demographic editions of books or catalogues of internal and external signatures containing individually tailored information or customized printing on selected signatures. This flexibility is important in satisfying the demands of a particular market or geographical destination. For instance, it may be desirable to offer certain customers or subscribers various features or selected advertising depending upon their special interest, income or occupation. Likewise, it may be relevant to customize products or services contingent upon a customer's previous buying history. For example, a publication may issue one demo edition for parents of newborn children who have purchased baby products, another edition for farmers interested in the latest milking machines and still another edition for recent purchasers of exercise equipment. In each situation, a publisher may utilize various modes of customization such as blown-in card feeding, invoicing, advertising material insertion, renewal notices and tipping, as well as several types of contact or contactless printing.

To provide these demographic versions, the prior art commonly employs an information source which indicates the special interest of each subscriber within a common postal locale. Based on the information source, a controller selectively actuates the signature feeders to deliver certain signatures upon the conveyor to form one or more individualized editions of a booklet or magazine for each subscriber within the zip code area. Information in the source is generally arranged in sequential order so that the formed booklets or magazines leave the conveyor ready to be sorted into groups which qualify for postal rate discounts. As part of the collation process, the signatures are conveyed past one or more customizing stations typically including a label head, card inserter, and/or dot matrix ink jet print heads mounted in predetermined relation to a support for the signatures. Examples of such systems are described in U.S. Pat. No. 3,819,173 issued June 25, 1974 to Anderson et al., and U.S. Pat. No. 4,121,818 issued Oct. 24, 1978 to Riley et al.

In some instances, a machine for packaging each individual magazine or printed product on the conveyor line is also provided. One example of this type of demographic bindery system is disclosed in U.S. Pat. No. 4,790,119 issued to McDaniels on Dec. 13, 1988. In this arrangement, a computer controls the dispensing of publications onto a conveyor and selectively deposits appropriate inserts on the publications as they move along the conveyor. A wrapping machine operates independently of the computer on demand to place a polymer film (envelope) around each publication and its appropriate insert. The conveyor then carries the wrapped publication past a printing unit actuated by the computer to address the envelope. The conveyor thereafter deposits the wrapped publications in a stacking machine controlled by the computer to optimally sort the publications for distribution. Finally, the sorted publications are delivered to a binding machine which operates on demand to place straps around the stacks of individually wrapped publications. See also U.S. Pat. No. 4,484,733 issued to Loos et al. on Nov. 27, 1984.

In other instances, machines for encasing stacked, sorted and/or strapped bundles of unwrapped publications en masse are employed at the end of the conveyor line. Examples of these machines are shown in U.S. Pat. No. 4,683,708 issued Aug. 4, 1987 to Linder and U.S. Pat. No. 4,831,809 issued May 23, 1989 to Ballestrazzi et al. These machines, known in the art as ideal wrappers, normally operate independently of a computer to place a protective plastic film around the entire bundle of publications before the publications are handled for distribution.

It is desirable that magazines be packaged to take maximum advantage of postal discounts. For example, bundles of six or more magazines to be sent by second class mail to subscribers having a common 3-digit zipcode prefix are entitled only to the basic or highest postal rate. However, a bundled group of six or more magazines sent to subscribers having a common 5-digit zipcode obtains a more favorable intermediate postal rate, and grouping six or more magazines sent to subscribers along the same carrier route, qualifies for a lower still postal rate. Accordingly, it is desirable that a bindery build magazines in an order that facilitates presorting and packaging to maximize postal discounts. In this regard, it would be advantageous in some instances if a plurality of magazines could be built and selectively custom packaged during a given production run, to facilitate grouping the various magazines destined for a given carrier route.

Prior art systems are disadvantageous primarily because of inflexibility. For example, even though wrapping each individual magazine prevents loss of inserts and preserves the appearance of the magazine, it may take too much time and money to wrap each individual magazine on the conveyor line. As a result, there can be a slowdown in production coupled with an attendant loss in selectivity in the customizing capability of the system. Absent the selective packaging of the magazine in accordance with the coded information used to assemble the magazine, there is no distinction between certain magazines which should be wrapped versus other magazines which should remain unwrapped yet be otherwise customized. Additional techniques of customizing selected magazines beyond the realm of conventional ink jet printing and/or supplementing devices need to be considered.

Accordingly, it is desirable that the demographic bindery system offer a greater degree of customization, improving upon the selectivity of the signatures to be personalized, and permit different magazines to be assembled during a single production run for subscribers in a given postal zone irrespective of varying points of customization.

SUMMARY OF THE INVENTION

The present invention advantageously provides an improved customizing capability for high speed demographic collators and binders. The improved system is particularly versatile and can be retrofit into existing systems.

These and other advantages are realized, in one aspect of the invention by a system having feeders for selectively delivering and processing signatures on a conveyor line according to coded information, the system including a packaging apparatus operatively connected with the conveyor line for selectively packaging signatures according to the coded information.

The present invention also relates to a method for customizing signatures being delivered on a conveyor line including the step of selectively wrapping signatures according to coded information.

In a highly preferred embodiment, the invention contemplates selectively diverting certain signatures according to coded information to a packaging station at which the signatures are wrapped, and returning the signatures selectively wrapped to the conveyor line in synchronism with the signatures being delivered on the conveyor line according to coded information.

BRIEF DESCRIPTION OF THE DRAWING

The invention will become better understood by reference to the following detailed description of the preferred exemplary embodiment when read in conjunction with the appended drawing wherein like numerals denote like elements and.

DETAILED DESCRIPTION OF THE PREFERRED EMBODIMENT

Figure 1A:
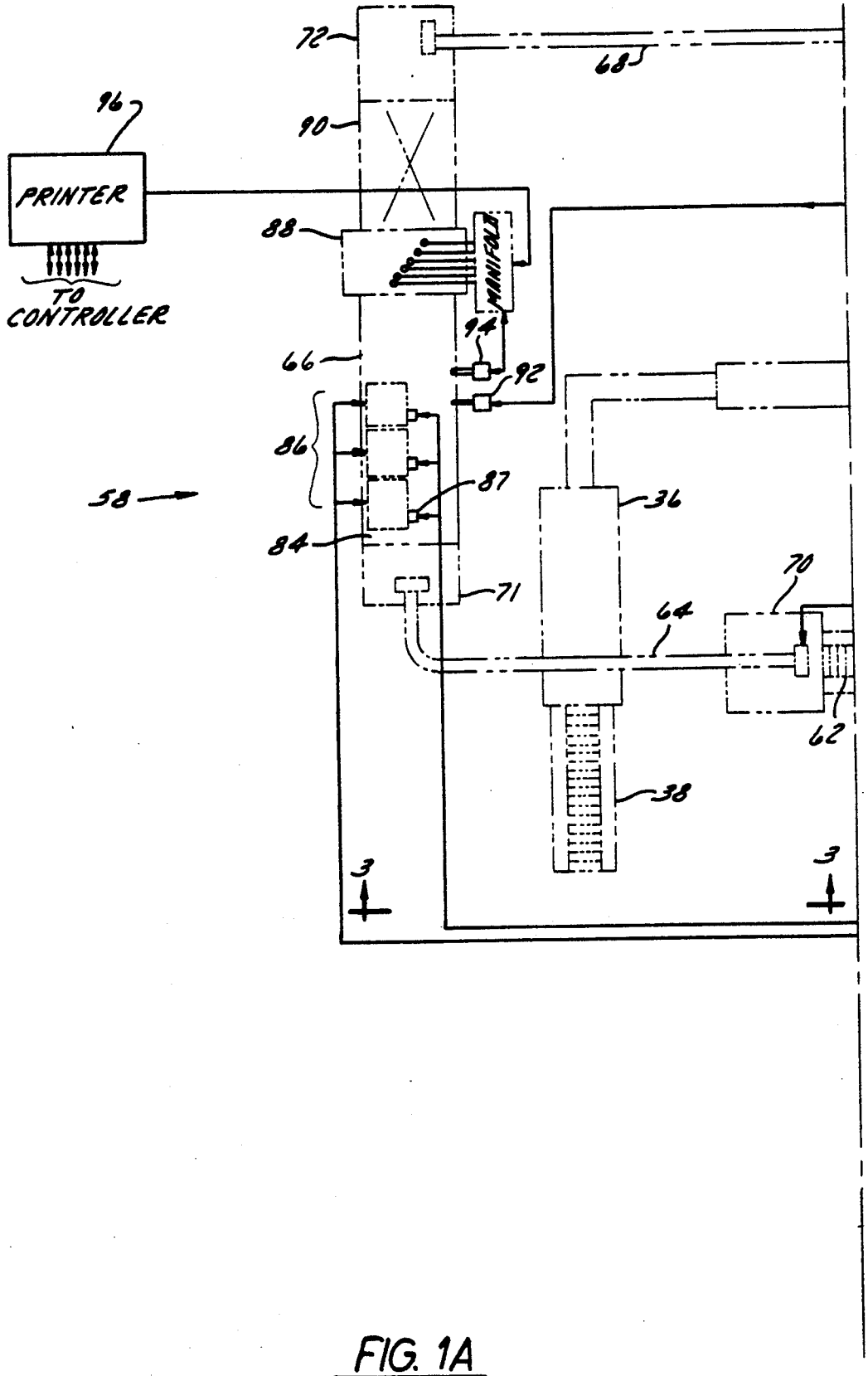
FIGS. 1A and 1B are schematic plan views of a customizing system employing the present invention.
Figure 1B:
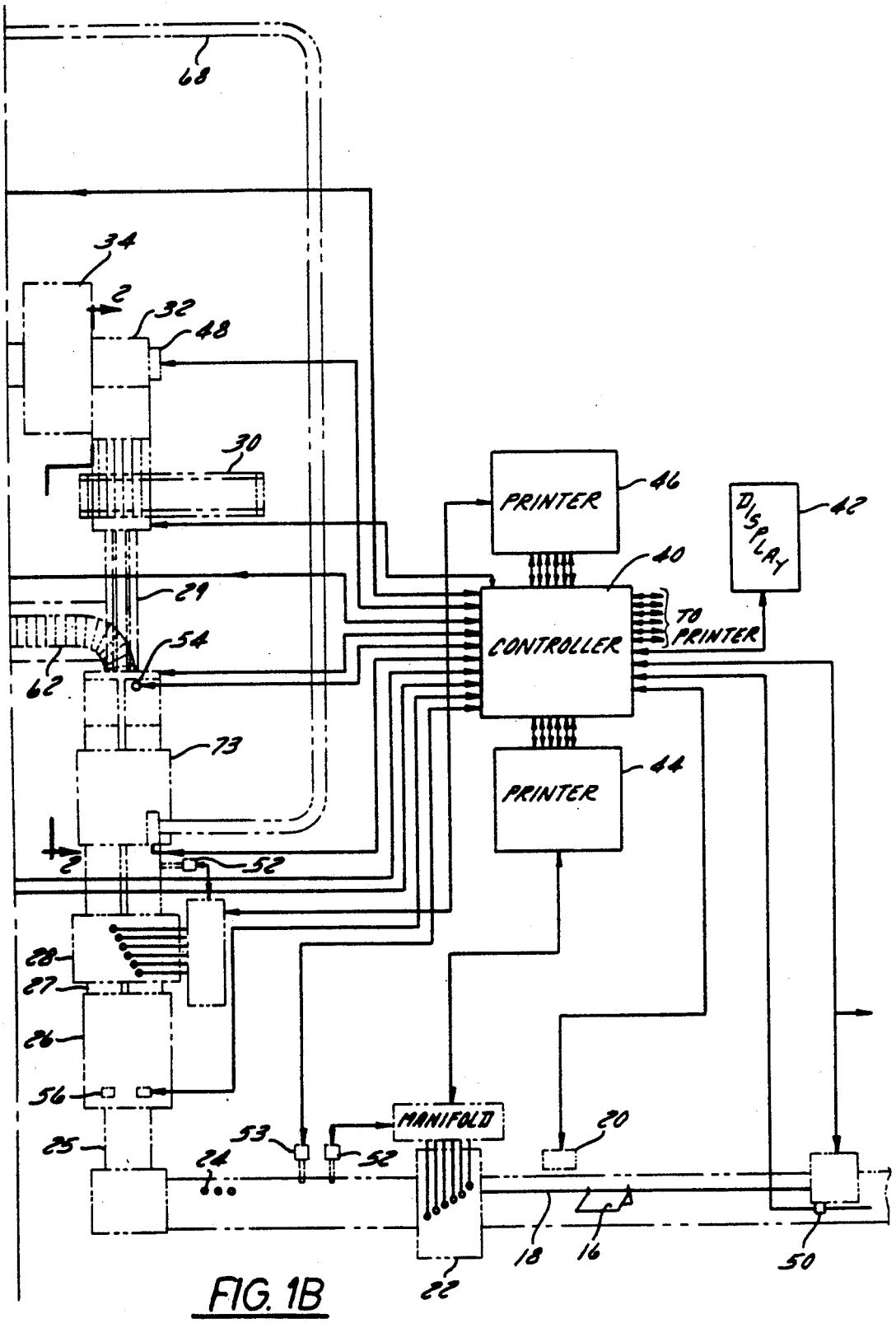

Referring to FIGS. 1A and 1B, a collation and binding (conveyor) line 10 for a saddle stitcher encompassed by the present invention is employed to produce various magazines, catalogues, brochures, periodicals, etc. containing different collections of signatures for different customers or subscribers. Line 10 suitably comprises an inserter 12 having a plurality of signature feeders, (boxes) 14, a collating chain (conveyor) 18, a caliper 20, a customizing station 22, a stitcher 24, a trimmer 26, a labeling station 28, a bad book conveyor 30, a stacker 32, a strapper 34 and an ideal wrapper 36.

Each feeder 14 holds a supply of signatures 16, and is designed to selectively deliver a singular signature 16 from a supply stack within the feeder 14 so that its folding margin or spine falls upon a collating chain or conveyor 18. Collating chain or conveyor 18 collects signatures 16 from signature feeders 14 and transports the signatures downstream for processing along collation and binding (conveyor) line 10. As signatures 16 are gathered, they move past caliper 20, which monitors the appropriate thickness of the book (signature collection) and then travel through a customizing station 22, preferably an ink jet printer, which applies personalized information to signatures being collated in a direction parallel to their spines. After the customizing, conveyor 18 pushes the signatures to stitcher 24 where they are bound, to create an assembled book such as by stapling or the like.

The assembled book is then diverted with its spine leading onto a flat conveyor 25 to trimmer 26 where its edges are trimmed, and next transported onto another conveyor (mailing table) 27 to labeling station 28 where a human readable mailing label is printed transverse to the spine or otherwise applied. In the preferred embodiment, a printer of the well known dot matrix type is utilized at stations 22 and 28 but it should be understood other types of contact and contactless printers may also be employed. Likewise, other suitable arrangements such as a blow-in card feeder or applique device may be used in conjunction with or in place of a printer as will be appreciated. After leaving mailing table 27, the assembled book is routed via a belt conveyor 29 to a diverter, at which point the book is either diverted to bad book conveyor 30 or passed through serially to stacker 32, strapper 34 and ideal wrapper 36 and readied for mail or other distribution at an exit conveyor 38.

The collating and binding line 10 generally described above is controlled by a conventional computer or programmable controller 40, having a display unit 42, the details of which are well known in the art except with respect to certain qualifications as will be hereafter explained. Likewise, the inserter 12, caliper 20, customizing station 22, stitcher 24, trimmer 26, labeling station 28, bad book conveyor 30, stacker 32, strapper 34 and ideal wrapper 36 are of conventional construction and do not require a detailed discussion.

Controller 40 is operatively connected to feeders 14 of inserter 12, to customizing station 22 and labeling station 28 and provides control signals thereto. Controller 40 operates each of stations 22 and 28 through the intermediary of conventional computer printers 44, 46, respectively. Stacker 32 is coupled with an auxiliary computer 48 which in turn is connected to controller 40 so that books will be sorted according to number and weight qualifying for the best available postal rate under carrier route sortation as is well understood.

It is common practice that the line 10 is monitored for the occurrence of errors as well as for inventory purposes through the collating and binding process. Accordingly, each of the feeders 14 carries a sensor 50 in communication with controller 40 for detecting a missed feed of a signature within each feeder 14. Likewise, caliper 20 is mounted adjacent conveyor 18 and sends an interrupt signal to controller 40 upon deviation of the collated signatures 16 from a prescribed thickness parameter. In addition, a pair of sensors 52 are positioned on line 10 to enable controller 40 to oversee the information applied at customizing station 22 and labeling station 28. An encoder 53 is typically placed adjacent conveyor 18 downstream of customizing station 28 to monitor the position of signatures 16. As is well known, encoder 53 gives an indication of angular or cyclical position, where one rotation corresponds to travel of one book space. A product detector 54 is positioned at the end of mailing table 27 to sense the presence or absence of each book on conveyor line 10. The controller 40 is further connected to a short book detector 56 at trimmer 26 to detect the presence of an unacceptably trimmed book. It should be understood that if at any point in the collating and binding process an erroneously prepared book is detected, or if no book is present when one should be present according to controller 40, this indication will be used to inhibit certain subsequent processing on the unsuitable book and reorder the book. Suitable reject mechanisms, such as shown at bad book conveyor 30, may be employed at various positions and regulated by controller 40 to extract the defective books from line 10.

A customized packaging system 58 is generally disposed downstream of labeling station 28, and is adapted to selectively operate upon collated, trimmed and labeled signatures 16 maintained in custody on line 10 in a product slot defined on line 10. As is well known, these product slots are monitored by encoder 53 to keep inventory of the books being formed in accordance with the movement of line 10.

Customized packaging system 58 embodying the present invention suitably comprises a book selector 60 cooperating with a divert conveyor 62, a transfer conveyor 64, a moving packaging line 66, a return conveyor 68 and book feeders 70, 71, 72, 73. As will be understood in more detail hereafter, certain books of signatures, as dictated by controller 40, are selectively diverted from line 10 to packaging line 66. On line 66, each selected book is further personalized by material supplementation, printing and/or individual wrapping before being returned to and in synchronism with line 10 as regulated by controller 40.

Book selector 60 is preferably a movable gate disposed at the downstream end of conveyor (mailing table) 27. Selector 60, responsive to controller 40, selects a particular book of signatures assembled on line 10 according to controller 40 to which enhanced customization is to be applied. Upon receiving a signal from controller 40, selector 60 cooperates with books travelling on mail table 27 to deflect certain selected books to divert conveyor 62 located beneath conveyor 29 on line 10. Those books not diverted continue along conveyor 29 towards stacker 32.

Figure 3:
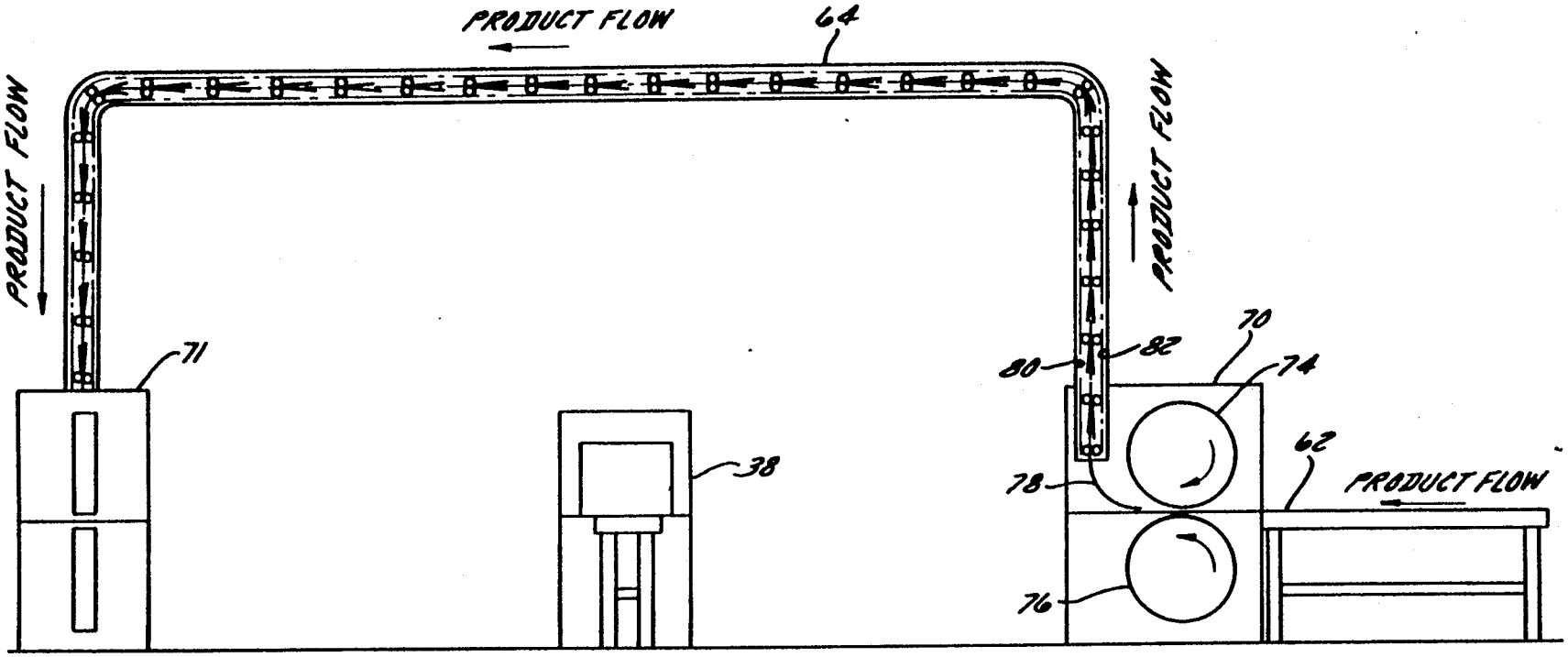
FIG. 3 is an enlarged, fragmentary sectional view of the system shown in FIG. 1A taken on line 3—3.

Referring briefly to FIG. 3, diverted books are transported on conveyor 62 to book feeder 70 which has a pair of feed rollers 74, 76 driven in opposite directions. Rollers 74, 76 are employed to deliver books onto a curved guide plate 78 leading upwardly between a pair of upper and lower belt conveyors 80, 82. Conveyors 80, 82 are continuously and oppositely driven to convey the selected books upwardly over ideal wrapper 36 and downwardly for delivery in spaced, flattened position to book feeder 71 at the upstream end of packaging line 66.

Referring again to FIGS. 1A and 1B, packaging line 66 includes a flat conveyor 84 for moving selected books serially past a group of onsert (externally deposited supplements) dispensing units 86, a printing station 88 and a wrapping machine 90. Dispensing units 86 each preferably carry a stack of different onserts in the form of cards, brochures, or samples which are generally flat. Units 86, like feeders 14, are conventional machines containing activating devices responsive to controller 40 to selectively release onserts upon the upwardly facing covers of books moving on conveyor 84. Each of the units 86 is provided with a sensor 87 connected with controller 40 for detecting a missed onsert feed. Controller 40 continues to track the position of each selected book by employing an encoder 92 positioned along line 66. Beyond the onsert dispensing units 86 lies printing station 88 monitored by another encoder 94 for applying a further personalized message to each selected book according to controller 40 in a direction transverse to the spine of each book. In the preferred embodiment, a printer 96 of the well known dot matrix ink jet type is utilized, but it should be understood that other types of contact and contactless printers or label applications may also be employed. Likewise, other suitable arrangements may be employed to open internal pages of each selected book and supplement inserts therein in place of or in conjunction with onsert dispensing units 86.

Immediately downstream of print station 88 is wrapping machine 90 which conventionally applies a transparent polymer film (polywrap) around each individual book selectively diverted from line 10 according to controller 40 and any onsert carried by the book. Wrapping machine 90 is conventional to the printing industry in completely enveloping, severing, heating and sealing a plastic-like, protective film around each product. Each diverted book which has now been supplemented by onserts and/or printing, and individually wrapped, forms a customized package which exits from wrapping machine 90, and enters book feeder 72 at the downstream end of packaging line 66.

Figure 2:
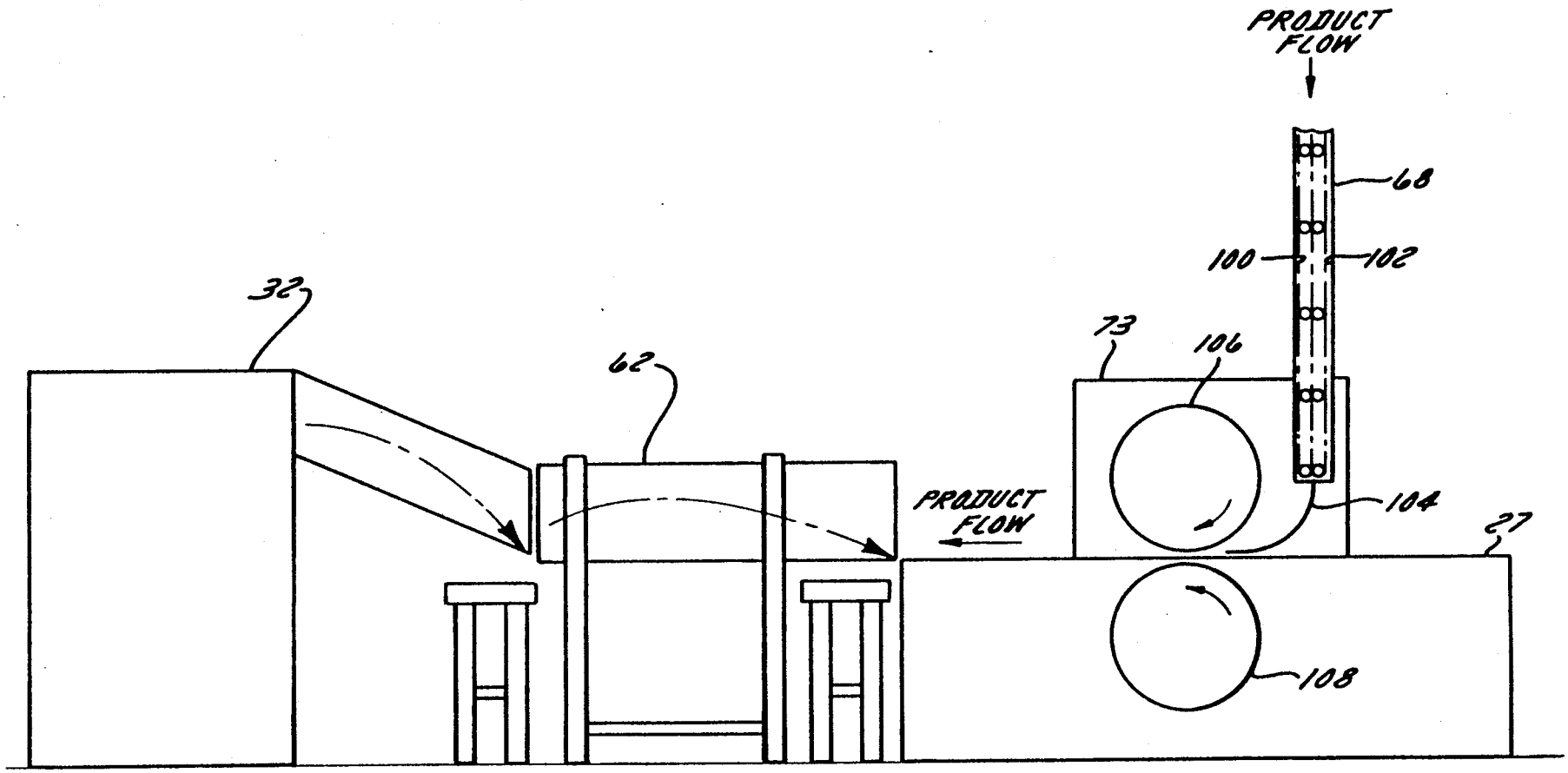
FIG. 2 is an enlarged, fragmentary sectional view of the system shown in FIG. 1B taken on line 2—2.

Referring now to FIGS. 1A, 1B and 2, feeder 72 orients each wrapped book and functions like feeder 70 to position each wrapped book between oppositely driven conveyor belts 100, 102 (FIG. 2) in a return conveyor 68 similar to transfer conveyor 64. Return conveyor 68 carries selectively wrapped books over a portion of line 10 for delivery to a curved guide plate 104 which directs each wrapped book between drive rollers 106, 108 of book feeder 73. Rollers 106, 108 are oppositely driven to deliver wrapped books into empty product slots on mail table 27 as reserved by controller 40 and thereby comingle wrapped books with unwrapped books already travelling on mail table 27. The combined stream of wrapped books from customized packaging system 58 and unwrapped books from line 10 is then conveyed to stacker 32 to be organized by controllers 40 and 48 for carrier route sortation. Referring again to FIG. 1B, each stack of books is then bundled at strapper 34, wrapped en masse at ideal wrapper 36 and directed onto exit conveyor 38 for distribution.

As previously stated, customized packaging system 58 of the present invention is controlled by a programmable computer (CPU) to which operates in a manner well known in the art to generally coordinate the various functions of the overall line 10. Examples of controllers of this type are described in Anderson et al. U.S. Pat. No. 3,819,173, Riley et al. U.S. Pat. No. 4,121,818, and Gruber U.S. Pat. No. 4,395,031. The control of book selector 60 is suitably effected as part of the collation process, integrated into the conventional control system. As in a conventional system, controller 40 monitors the position of the signature 16 being transported on conveyor line 10, by for example encoder 53. A respective data record, associated with each product (book) to be collated, is accessed, in sequence, from an information source, typically a magnetic tape. In a conventional system such record would include: coded information (a product build descriptor) designating the particular feeders 14 to be actuated to build the book (i.e., the particular component signatures of the book); indicia of the identity and address of the subscriber for which the book is being assembled; and customization information, e.g., a particular message to be printed in the book, actuation indicia for a card inserter, or applique device and the like. On line 10, in accordance with the present invention, such customization information would also include a coded designation (book selection control field) identifying books for which customized packaging is to be effected, e.g., the particular onsert dispensing units 86 to be actuated, and where multiple ink jet heads or devices are employed at print station 88, the particular heads or devices to be actuated, etc.

Figure 4:
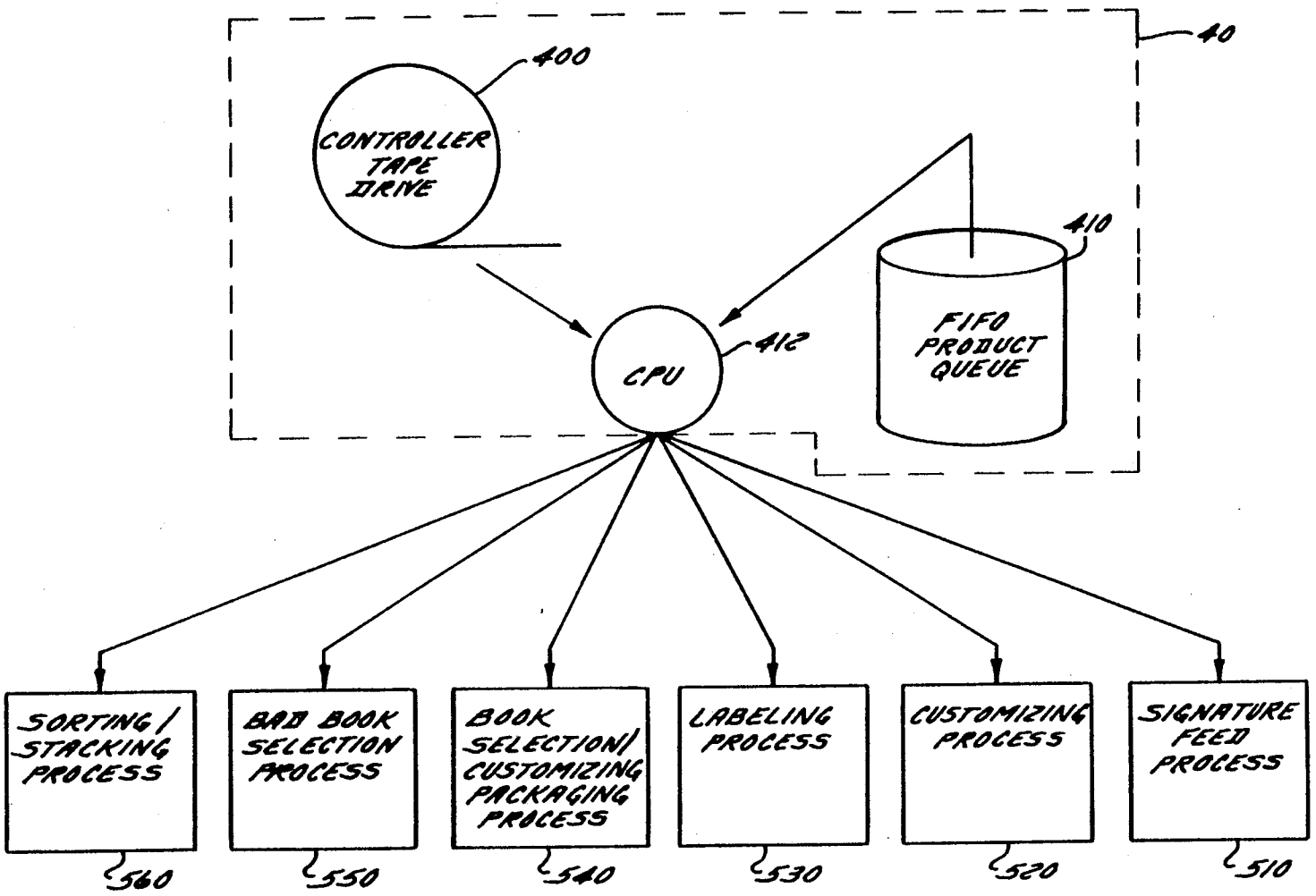
FIG. 4 is a diagram of the computerized control system used with the present invention.

It has been found practical at the beginning of a production run for a particular carrier route to first build a group of books which are to be selectively packaged so that system 58 can be efficiently primed. Referring to FIG. 4, product data records organized as desired for a particular carrier route are sequentially retrieved from storage, e.g., read from the magnetic tape by tape drive 400 associated with controller 40. Each record is sequenced through a first in first out (FIFO) queue 410 maintained in the random access memory of computer 40. In general, the position of the record in the queue 410 corresponds to the relative position of the associated product along the conveyor line 10. As a product slot advances along conveyor 18, feeders 14 are selectively actuated in accordance with the product build descriptor contained in the associated record in a conventional manner (represented in the state diagram of FIG. 4 as signature feed process 510). Once a particular product (book) has been built, the product is presented to customizing unit 22. Customization is then effected in accordance with customization information in the product record (customizing process 520). For example, one or more of the signatures in the book may be imprinted with contents of a message field in the record. The product is thereafter subjected to labelling in accordance with an associated control field in the product record (labelling process 530).

Figure 5:
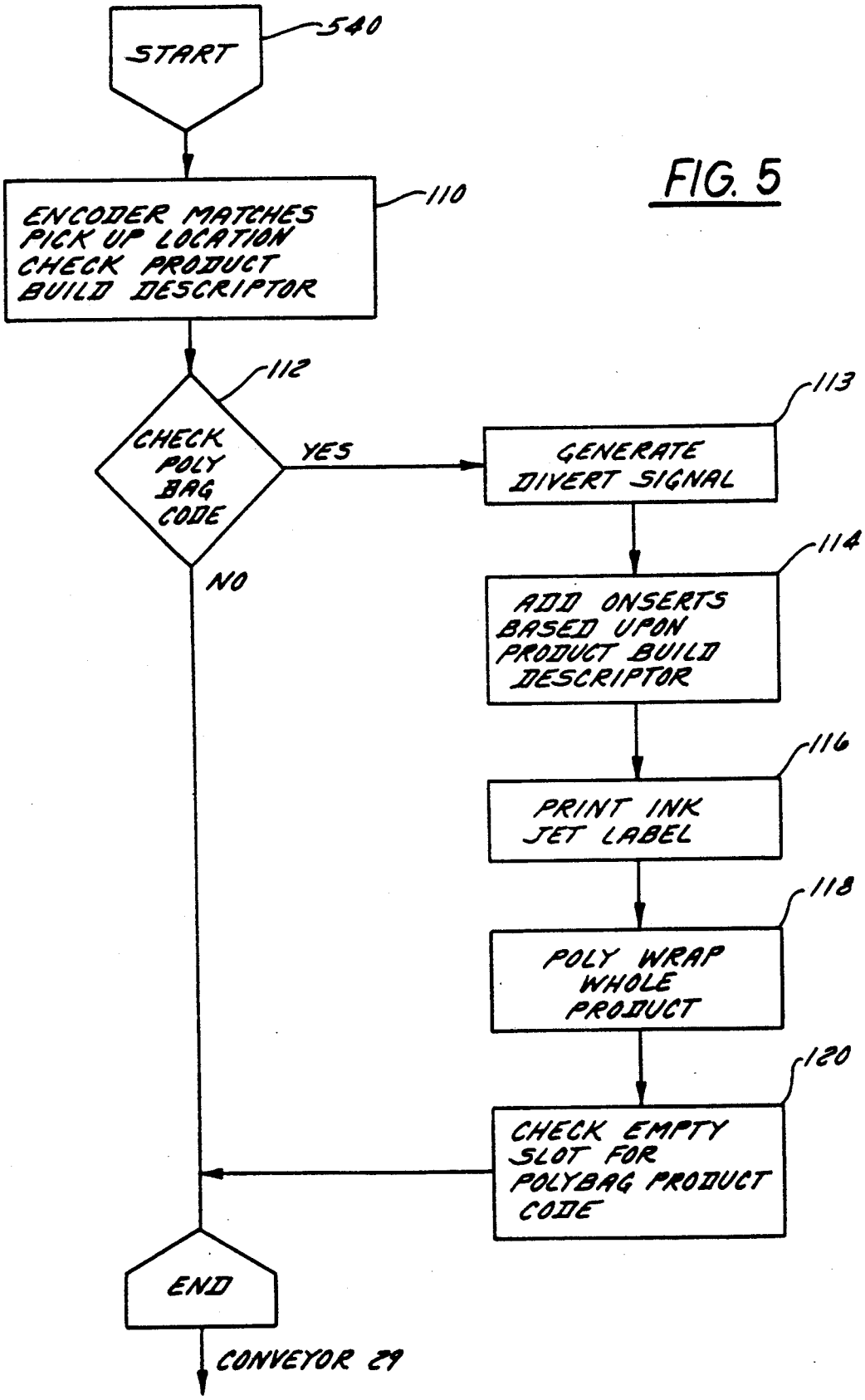
FIG. 5 is a flow chart for the interrupt service routine associated with the present invention.

When a given product reaches the location of book selector 60, rotation of encoder 53 will generate an interrupt to controller 40 causing a book selection, service routine 540 to be executed to generate appropriate control signals for governing customized packaging. More specifically, referring to FIG. 5, upon initiation of service routine 540, the product build descriptor is checked (step 110) and the polywrap code is accessed (step 112) (e.g. loaded into a working register associated with CPU 412) to determine which books are to be individually packaged and those which are to remain unpackaged on line 10. In the absence of a polybag code, a book arriving at book selector 60 will simply be transported unwrapped onto conveyor 29. If a book is to be polywrapped, a control signal is sent to book selector 60 to divert the book to packaging line 66 (step 113) where onserts are selectively added pursuant to the product build descriptor (step 114), a label or message may be inkjetted according to the product build descriptor (step 116) and polywrapping of the individual book is efffected (step 118). After being selectively packaged, the book is eventually deposited into its own discrete empty product slot (step 120) reserved on line 10 according to the polybag code, and simultaneously comingled into the stream of other assembled, unwrapped books moving on line 10.

Referring again to FIGS. 1A and 1B, the resulting stream of individually wrapped and unwrapped books then proceeds down line 10 to bad book conveyor 30. Here it is either diverted (bad book selection process 550) by controller 40 according to error signals such as from sensors 50, 52, 87, caliper 20, encoder 53, and detector 56, or is conveyed through to stacker 32 where carrier route sortation is implemented in accordance with associated control fields in the product record (sorting/stacking process 560). As is well known, the error signals are used by controller 40 to reorder books found defective.

Upon completion of the stacking process, the product record associated with the particular book is removed from queue 410 and a new product record is retrieved from storage through tape drive 400. As should be appreciated, each of the various processes 510, 520, 530, 540, 550 and 560 are effected in tandem upon different products at various positions along line 10.

It should be recognized that the present invention greatly enhances the flexibility of customizing signatures in a collating and binding system and allows magazines having various types of customization to be produced for subscribers in a given postal zone. For example, it may be desirable to send to one subscriber an unwrapped magazine with personalized messages and send his neighbor, a new subscriber, a wrapped magazine including a coupon for free/discounted merchandise, a welcome greeting and a sample of a flat packaged new product such as a compact disc, a shampoo packet, or the like. Unlike prior art systems which wrap each customized publication on line, the present invention provides improved selectivity, which saves money and time by wrapping only preselected books, yet offers further customization and optimal sortation.

While the invention has been described with reference to a preferred embodiment, those skilled in the art will appreciate that certain substitutions, alterations and omissions may be made without departing from the spirit thereof. For example, while the preferred form of the invention discloses a saddle stitcher, the customized packaging system would function equally well in a perfect binding arrangement. Likewise, the invention may be used on a line selectively dispensing assembled books. Accordingly, the foregoing decription is meant to be exemplary only and should not be deemed limitative on the scope of the invention set forth in the following claims.

I claim:

1. A signature customizing system of the type including a conveyor line and a plurality of feeders for selectively delivering and processing signatures on said conveyor line in groups of completed books according to coded information, the system including:

packaging means, operatively connected with said conveyor line, for selectively wrapping said signatures of said completed books in accordance with said coded information.

2. The system of claim 1, including selection means, responsive to said coded information, for selectively diverting certain of said signatures from said conveyor line to said packaging means to be selectively wrapped and maintaining other of said signatures unwrapped upon said conveyor line.

3. The system of claim 2, including transfer means for returning said signatures selectively wrapped from said packaging means to said conveyor line in synchronism with said signatures being delivered and processed on said conveyor line according to said coded information.

4. The system of claim 3, including stacking means located on said conveyor line and responsive to said coded information for sorting certain of said signatures selectively wrapped in said packaging means together with other of said signatures maintained unwrapped on said conveyor line.

5. The system of claim 2, wherein said selection means includes means for delivering said selectively diverted signatures in a flattened position to said packaging means.

6. The system of claim 1, including first customizing means adjacent said conveyor line and responsive to said coded information for selectively applying customized information to said signatures being delivered and processed on said conveyor line.

7. The system of claim 2, wherein said packaging means includes second customizing means responsive to said coded information for selectively applying customized information to certain of said signatures before wrapping of said signatures.

8. The system of claim 3, wherein said transfer means returns said signatures selectively wrapped to said conveyor line downstream of said first customizing means.

9. The system of claim 1, wherein said packaging means further includes supplement means for selectively delivering onserts to said signatures.

10. A method for customizing signatures in a system of the type having a conveyor line and feeding means for delivering signatures in groups of completed books to said conveyor line according to coded information, said method comprising the step of:

selectively wrapping said signatures of said completed books according to said coded information.

11. The method of claim 10, wherein the step of selectively wrapping said signatures according to said coded information includes the steps of:

selectively diverting certain of said signatures according to said coded information to a packaging station at which said signatures are wrapped; and returning said signatures selectively wrapped to said conveyor line in synchronism with said signatures being delivered on said conveyor line according to said coded information.

12. The method of claim 11, including the step of selectively adding onserts to said signatures before selectively wrapping said signatures.

13. A system for collating signatures, said system being the type including:

a controller, cooperating with a source of subscriber information for generating control signals in accordance with said subscriber information;

a conveyor line;

a plurality of feeders responsive to control signals from said controller for delivering signatures to said conveyor line in groups forming books; and customizing means operatively connected to said conveyor line for effecting a customizing operation on said signatures, said system improved wherein:

said controller includes means for generating signals designating certain of said books to be customized remote from said conveyor line; and said customizing means further comprises means for selectively packaging, according to said coded information, certain individual ones of said books designated by said controller.

14. The system of claim 13, wherein said customizing means further includes supplement means for selectively delivering onserts to said books.

15. The system of claim 13, further including stacking means adjacent said conveyor and responsive to said controller for sorting said signatures according to said subscriber information.

16. The system of claim 15, wherein said means for selectively packaging individually certain of said signatures is interposed between said feeders and said stacking means.

17. The system of claim 13, wherein said means for selectively packaging individually certain of said books includes:

means for selectively supplying certain of said books with substantially flat supplements;

means for selectively printing messages on certain of said books; and means for selectively wrapping certain of said books in a polymer film.

18. The system of claim 13, certain of said books designated by said controller being deliverable to said conveyor line before any other of said signatures.

19. A method of collating signatures, comprising the steps of:

generating control signals in accordance with subscriber information, said control signals including signals indicative of particular signatures associated with individual subscribers and designating certain of said signatures for individual packaging;

responsive to said control signals, delivering said signatures to a conveyor line; and responsive to said control signals, controllably diverting said designated signatures from said conveyor line to be individually packaged and returning said individually packaged signatures to said conveyor line.

* * * * *